US008356862B2

(12) United States Patent
Biermann

(10) Patent No.: US 8,356,862 B2
(45) Date of Patent: Jan. 22, 2013

(54) ADJUSTMENT MECHANISM AND INCLINATION-ADJUSTABLE SEAT

(75) Inventor: Eric Biermann, Amsterdam Zuidoost (NL)

(73) Assignee: Nuna International B.V. (NL)

( * ) Notice: Subject to any disclaimer, the term of this patent is extended or adjusted under 35 U.S.C. 154(b) by 168 days.

(21) Appl. No.: 12/923,976

(22) Filed: Oct. 19, 2010

(65) Prior Publication Data

US 2011/0089734 A1 Apr. 21, 2011

(30) Foreign Application Priority Data

Oct. 21, 2009 (CN) ..... 2009 1 0208064

(51) Int. Cl.
*B60N 2/20* (2006.01)
*B60N 2/22* (2006.01)

(52) U.S. Cl. ..... 297/354.12; 297/354.1; 297/376

(58) Field of Classification Search ..... 297/274, 297/354.1, 354.12, 376; 403/316, 319, 322.2, 403/377

See application file for complete search history.

(56) References Cited

U.S. PATENT DOCUMENTS

| | | | | |
|---|---|---|---|---|
| 2,289,818 | A * | 7/1942 | Winner et al. | 403/108 |
| 3,351,359 | A * | 11/1967 | Ferraris | 285/7 |
| 5,676,483 | A * | 10/1997 | Koubek | 403/109.3 |
| 6,739,666 | B2 * | 5/2004 | Alampi | 297/337 |
| 7,380,881 | B2 * | 6/2008 | Freed et al. | 297/318 |
| 7,780,236 | B2 * | 8/2010 | Bergkvist | 297/354.12 |
| 7,832,744 | B2 * | 11/2010 | Chen et al. | 297/354.12 X |

OTHER PUBLICATIONS

Partial European Search Report for European patent application No. 10187229.9, May 23, 2011.

* cited by examiner

*Primary Examiner* — Rodney B White
(74) *Attorney, Agent, or Firm* — Bacon & Thomas, PLLC

(57) ABSTRACT

An adjustment mechanism and an inclination-adjustable seat are provided. The inclination-adjustable seat comprises a connecting base, a seat frame, at least one adjustment mechanism and a supporting base, wherein the seat frame is connected to the connecting base, the adjustment mechanism is adapted to adjust the inclination of the inclination-adjustable seat and is connected to the seat frame and the connecting base, and the supporting base is connected to the connecting base for supporting the connecting base.

14 Claims, 4 Drawing Sheets

ADJUSTMENT MECHANISM AND INCLINATION-ADJUSTABLE SEAT

BACKGROUND OF THE INVENTION

1. Field of the Invention

The present invention relates to an adjustment mechanism and an inclination-adjustable seat, and in particular to an inclination-adjustable seat utilizing an adjustment mechanism.

2. Description of the Prior Art

WO 2008004959 discloses a bouncing cradle, which utilizes an adjusting device having grooves to adjust the angle of inclination. The change of the angle of inclination can be achieved by shifting a rod to adjust the position of the rod in the grooves. Since the adjusting device is complicated in structure and limited in size, the adjustable range of inclination is small.

GB 2380663 discloses a baby support, which can be adjusted to the best angle in an incubator. The inclination of the baby support is adjusted by moving and locking a knob in a slot. Since when adjusting the inclination of the baby support the knobs on both sides of the baby support must be simultaneously adjusted to the same position, it is inconvenient for the control of inclination.

To solve the above problem, the present invention provides an adjustment mechanism and an inclination-adjustable seat.

SUMMARY OF THE INVENTION

Accordingly, it is an object of the present invention to provide an adjustment mechanism for adjusting the inclination of a seat, in which the length of the adjustment mechanism can be adjusted by expanding or extracting a connecting tube and a support rod.

It is another object of the present invention to provide an inclination-adjustable seat, the inclination of which can be adjusted.

In accordance with one aspect of the present invention, an adjustment mechanism for adjusting the inclination of a seat is provided. The adjustment mechanism comprises: a connecting tube configured to be connected to the seat at one end thereof and having a receiving hole; a supporting rod configured to telescope with the connecting tube at one end thereof and to be connected to the seat at the other end thereof, the supporting rod having a plurality of positioning holes each of which can correspond respectively to the receiving hole; a positioning element configured to be provided in the receiving hole and in one of the positioning holes corresponding to the receiving hole so that the supporting rod can be positioned in the connecting tube; and an adjusting member configured to adjust the position of the supporting rod relating to the connecting tube, the adjusting member having a channel, wherein when the channel coincides with the receiving hole, the position of the supporting rod with respect to the connecting tube can be changed.

Preferably, in the adjustment mechanism, the adjustment mechanism is rotatably connected to the connecting tube and further includes an elastic element, one end of the elastic element being connected to one end of the connecting tube, the other end of the elastic element being connected to the adjusting member.

Preferably, in the adjustment mechanism, the channel has a slant surface enabling the positioning element to shift along the slant surface with the rotation of the adjusting member.

Preferably, in the adjustment mechanism, the positioning element is a sphere body such that the position of the supporting rod with respect of the connecting tube can be changed by providing the sphere body in different positioning holes.

Preferably, in the adjustment mechanism, the adjusting mechanism further includes a fastening element such that the fastening element penetrates first through holes of the connecting tube, second through holes of the adjusting member and a through opening of the supporting rod, thereby connecting the connecting tube, the adjusting member and the supporting rod, and the first through holes are provided opposite to each other in the wall of the connecting tube, the adjusting member is in the form of hollow tube body, and the second through holes are provided opposite to each other in the wall of the tube body of the adjusting member.

Preferably, in the adjustment mechanism, the adjusting member is a hand grip having a gripping portion, and the adjusting member can rotate with respect to the connecting tube.

Preferably, in the adjustment mechanism, the size of the first through holes is substantially larger than that of the second through holes.

In accordance with another aspect of the present invention, an inclination-adjustable seat is provided. The inclination-adjustable seat comprises: a connecting base; a seat frame configure to be pivotally connected to the connecting base; a supporting base configured to be pivotally connected to the connecting base, the supporting base being adapted to support the connecting base; and at least one adjustment mechanism configure to adjust the inclination of the inclination-adjustable seat, the adjustment mechanism being pivotally connected to the seat frame and the connecting base. The adjustment mechanism further includes: a connecting tube configured to be connected to the seat at one end thereof and having a receiving hole; a supporting rod configured to telescope with the connecting tube at one end thereof and to be connected to the seat at the other end thereof, the supporting rod having a plurality of positioning holes each of which can correspond respectively to the receiving hole; a positioning element configured to be provided in the receiving hole and in one of the positioning holes corresponding to the receiving hole so that the supporting rod can be positioned in the connecting tube; and an adjusting member configured to rotatably receive and telescope with the connecting tube and the supporting rod, the adjusting member having a channel, wherein when the channel coincides with the receiving hole, the positioning element moves out of the positioning hole corresponding to the receiving hole, thereby adjusting the inclination of the inclination-adjustable seat.

Preferably, in the inclination-adjustable seat, the adjustment mechanism further includes an elastic element, one end of the elastic element being connected to one end of the connecting tube, the other end of the elastic element being connected to the adjusting member.

Preferably, in the inclination-adjustable seat, the channel has a slant surface enabling the positioning element to shift along the slant surface with the rotation of the adjusting member.

Preferably, in the inclination-adjustable seat, the positioning element is a sphere body such that the position of the supporting rod in the connecting tube changes by providing the sphere body in different positioning holes.

Preferably, in the inclination-adjustable seat, the adjusting mechanism further includes a fastening element such that the fastening element penetrates first through holes of the connecting tube, second through holes of the adjusting member and a through opening of the supporting rod, thereby connecting the connecting tube, the adjusting member and the supporting rod, and the first through holes are provided opposite to each other in the wall of the connecting tube, the adjusting member is in the form of hollow tube body, and the second through holes are provided opposite to each other in the wall of the tube body of the adjusting member.

Preferably, in the inclination-adjustable seat, the adjusting member is a hand grip having a gripping portion, and the adjusting member can rotate with respect to the connecting tube.

Preferably, in the inclination-adjustable seat, the size of the first through holes is substantially larger than that of the second through holes.

Preferably, in the inclination-adjustable seat, the adjustable inclination is substantially in the range of 35 degrees to 55 degrees.

Further and other objects and characteristics of the present invention will be made clear by a preferred embodiment described below referring to accompanying drawings.

BRIEF DESCRIPTION OF THE DRAWINGS

Hereinafter, an inclination-adjustable seat according to a preferred embodiment of the present invention is described in detail with reference to the attached drawings.

DETAIL DESCRIPTION OF THE PREFERRED EMBODIMENT

These and other features, aspects and advantages of the present invention will become more apparent from the following description with reference to the accompany drawings.

Structure

Figure 1A:
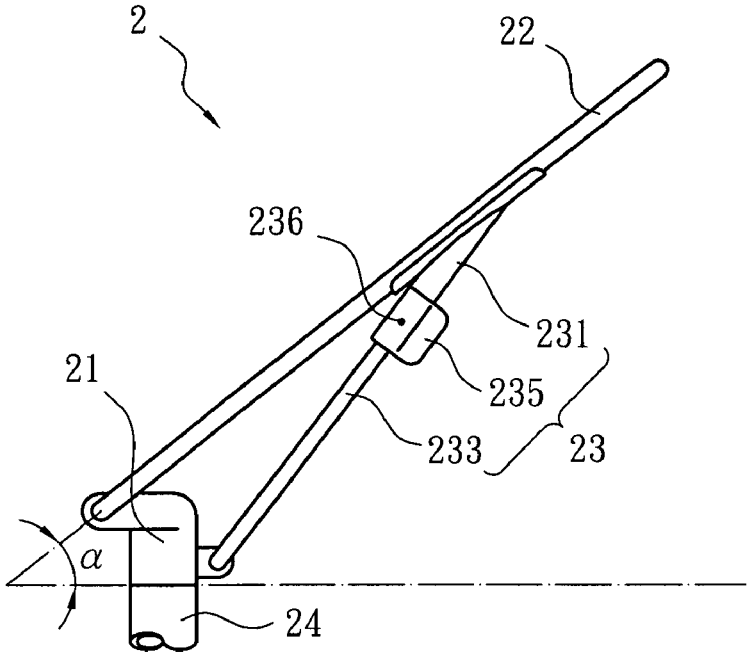
FIGS. 1A and 1B are partial side views showing an inclination-adjustable seat according to the present invention.
Figure 1B:
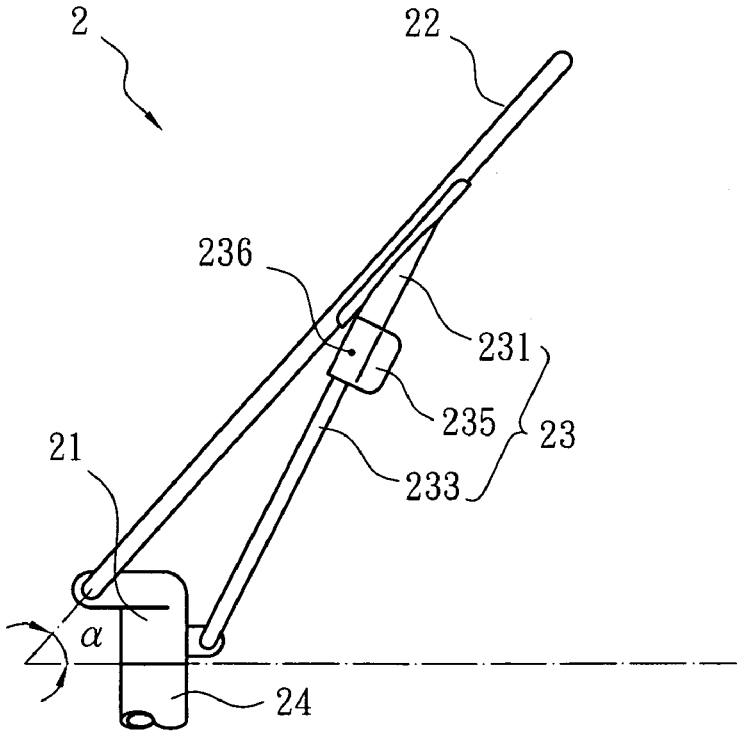

An inclination-adjustable seat 2 according to a preferred embodiment of the present invention is described with reference to FIGS. 1A-4B. According to the present invention, the inclination of the inclination-adjustable seat 2 with respect to the floor is adjustable. In the preferred embodiment of the present invention, the inclination-adjustable seat 2 is positioned in a first inclination (as shown in FIG. 1A) and in a second inclination (as shown in FIG. 1B). Thereby, a user can comfortably sit on the inclination-adjustable seat 2 by selecting a desired inclination.

As shown in FIG. 1A or 1B, the inclination-adjustable seat 2 comprises a connecting base 21, a seat frame 22, two adjustment mechanisms 23 and a supporting base 24.

The seat frame 22 is pivotally connected to the connecting base 21. The adjustment mechanisms 23 are adapted to adjust an inclination angle $\alpha$ of the inclination-adjustable seat 2 with respect to a ground level, and are pivotally connected to the seat frame 22 and the connecting base 21. In the embodiment of the present invention, the two adjustment mechanisms 23 are provided on both sides of inclination-adjustable seat 2.

Figure 2A:
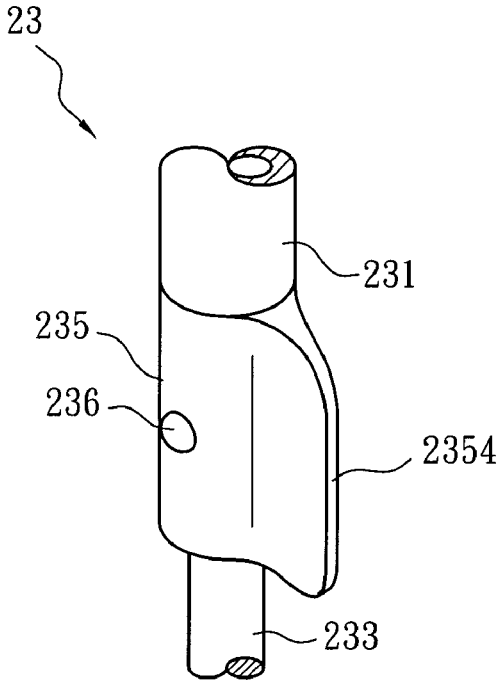
FIGS. 2A and 2B are a perspective view and a disassembled view of an adjustment mechanism of the inclination-adjustable seat according to the present invention.
Figure 2B:
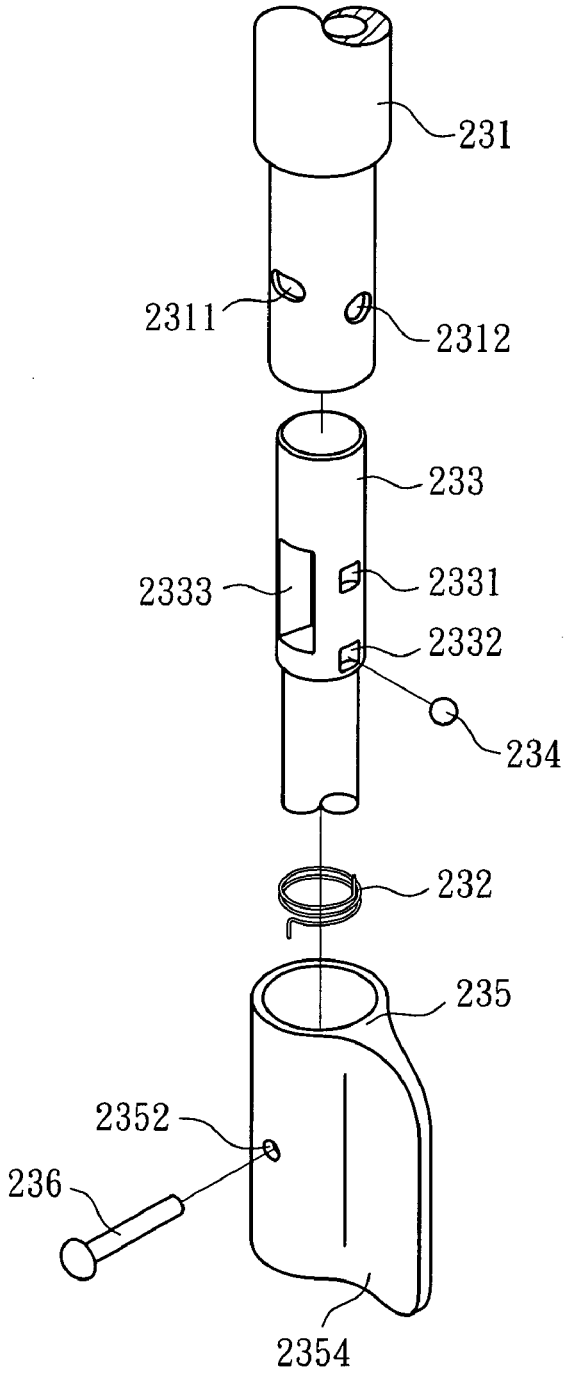

Then, referring to FIGS. 2A and 2B, FIGS. 2A and 2B are a perspective view and a disassembled view of an adjustment mechanism of the inclination-adjustable seat according to the present invention. Each of the adjustment mechanisms 23 includes a connecting tube 231, an elastic element 232, a supporting rod 233, a positioning element 234, an adjusting member 235 (that is a hand grip in the embodiment of the present invention), and a fastening element 236. An upper end of the connecting tube 231 is connected to the seat frame 22. The connecting tube 231 includes two first through holes 2311 and a receiving hole 2312 provided on the surface thereof, in which the first through holes 2311 are opposite to each other. One end of the elastic element 232 is connected to a lower end of the connecting tube 231. In the embodiment of the present invention, the elastic element 232 is, but not limited to, a torsional spring, and can be any element having elasticity or resilience.

One end of the supporting rod 233 passes through the elastic element 232 and enters (telescopes) the connecting tube 231, and the other end thereof is connected to the connecting base 21. The connecting tube 233 includes two positioning holes 2331, 2332 and a through opening 2333 provided on the surface thereof, in which the positioning holes 2331, 2332 are located on the side surface thereof corresponding to the receiving hole 2312 of the connecting tube 231. Simultaneously referring to FIG. 1A, FIGS. 2A and 2B and FIG. 3A, the fastening element 236 penetrates the connecting tube 231, the supporting rod 233, and the adjusting member 235 from the left to the right in the horizontal direction of the inclination-adjustable seat 2. Accordingly, there exists a difference in height between the positioning holes 2331, 2332 and the receiving hole 2312. In the embodiment of the present invention, the positioning holes 2331, 2332 are provided in the same straight line correspondingly to the receiving hole 2312. It is noted that the number of the positioning holes is not limited to two, but can be three or more. In the embodiment of the present invention, the outer diameter of the supporting rod 233 is substantially smaller than the inner diameter of the connecting tube 231, so that the supporting rod 233 can insert into the connecting tube 231.

The positioning element 234 is movably provided in the receiving hole 2312 and one of the positioning hole 2331 or the positioning hole 2332, so that the positioning element 234 is positioned in the positioning hole 2331 or the positioning hole 2332 to change the corresponding position of the supporting rod 233 in the connecting tube 231. In the embodiment of the present invention, the positioning element 234 is, but not limited to, a steel bead. By placing the positioning element 234 in different positioning holes (e.g., the positioning hole 2331 or the positioning hole 2332), the position of the supporting rod 233 in the connecting tube 231 can be changed, therefore the adjustment of inclination of the inclination-adjustable seat 2 can be achieved. Thus, the more the number of the positioning holes is, the more the selectivity of inclination of the inclination-adjustable seat 2 is.

Figure 3A:
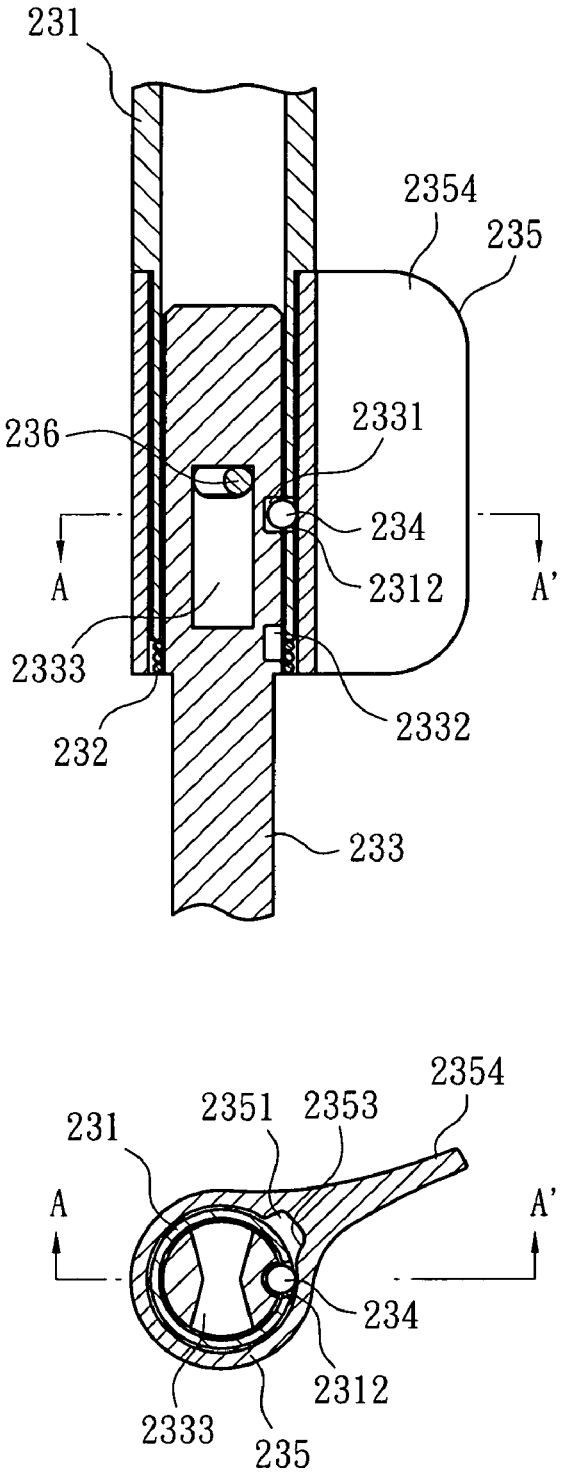
FIGS. 3A and 3B are cross-sectional views of the adjustment mechanism showing a state in which the inclination-adjustable seat according to the present invention is positioned in a second inclination.
Figure 4A:
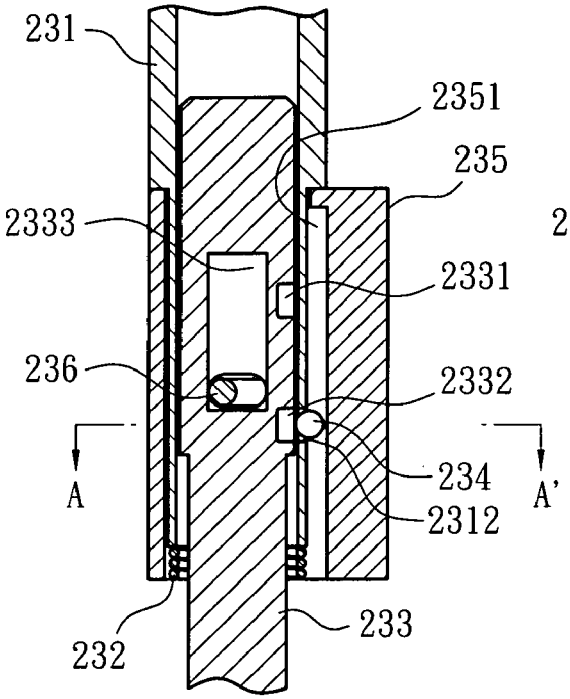
FIGS. 4A and 4B are cross-sectional views of the adjustment mechanism showing a state in which the inclination-adjustable seat according to the present invention is positioned in a first inclination.
Figure 4A:
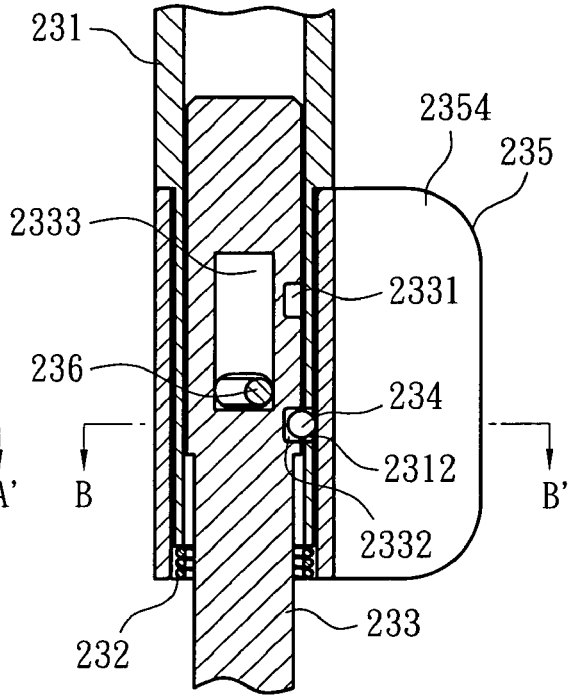
Figure 4A:
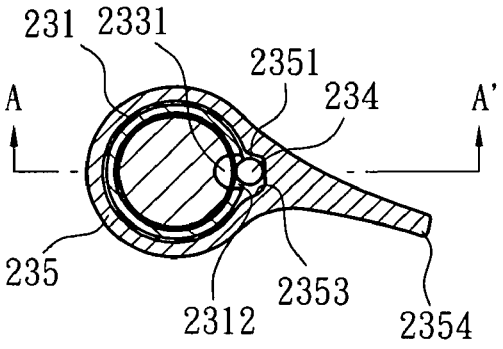

The adjusting member 235 is in the form of tube body for the connecting tube 231 and the supporting rod 233 to enter therein. The adjusting member 235 is connected to the other end of the elastic element 232 on the inner side wall. The adjusting member 235 is adapted to switch the position of the positioning element 234 in the positioning hole 2331 or the positioning hole 2332. The adjusting member 235 includes a channel 2351 and two second through holes 2352 on the tube body thereof. The second through holes 2352 are provided opposite to each other in the adjusting member 235. In the embodiment of the present invention, the channel 2351 has a slant surface 2353, as shown in FIGS. 3A and 4A.

As shown in FIGS. 2A-2B, in the embodiment of the present invention, the positioning element 234 is placed in the receiving holes 2312 through the inside of the connecting tube 231 and then matched with the positioning hole 2331 or the positioning hole 2332. Furthermore, the positioning element 234 is simultaneously located in the receiving hole 2312 and one of the positioning hole 2331 or the positioning hole 2332 to fix the inclination angle α of the inclination-adjustable seat 2. In the embodiment of the present invention, the size of the first through holes 2311 is substantially larger than that of the second through holes 2352.

The fastening element 236 penetrates the first through holes 2311, the second through holes 2352 and the through opening 2333. The fastening element 236 is adapted to connect the connecting tube 231, the adjusting member 235 and the supporting rod 233. In the embodiment of the present invention, the fastening element 235 is, but not limited to, a rivet.

Operation

Figure 4B:
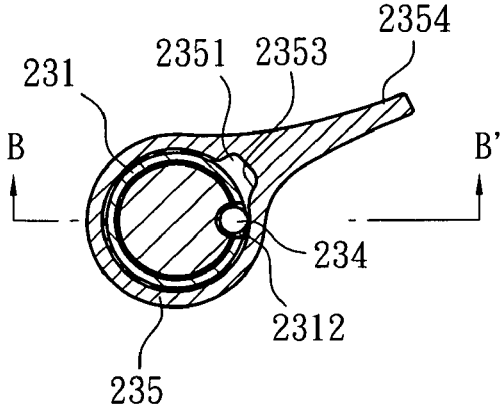

A method of adjusting the inclination of the inclination-adjustable seat 2 by the adjustment mechanisms 23 is described below. As shown in FIGS. 1A and 4B, the inclination-adjustable seat 2 is in the state of first inclination, in which the positioning element 234 is located in the receiving hole 2312 and the positioning hole 2332. In the embodiment of the present invention, the inclination angle α in the state of first inclination is about 35 degrees to 40 degrees, or specifically, 39 degree in one embodiment.

Figure 3B:
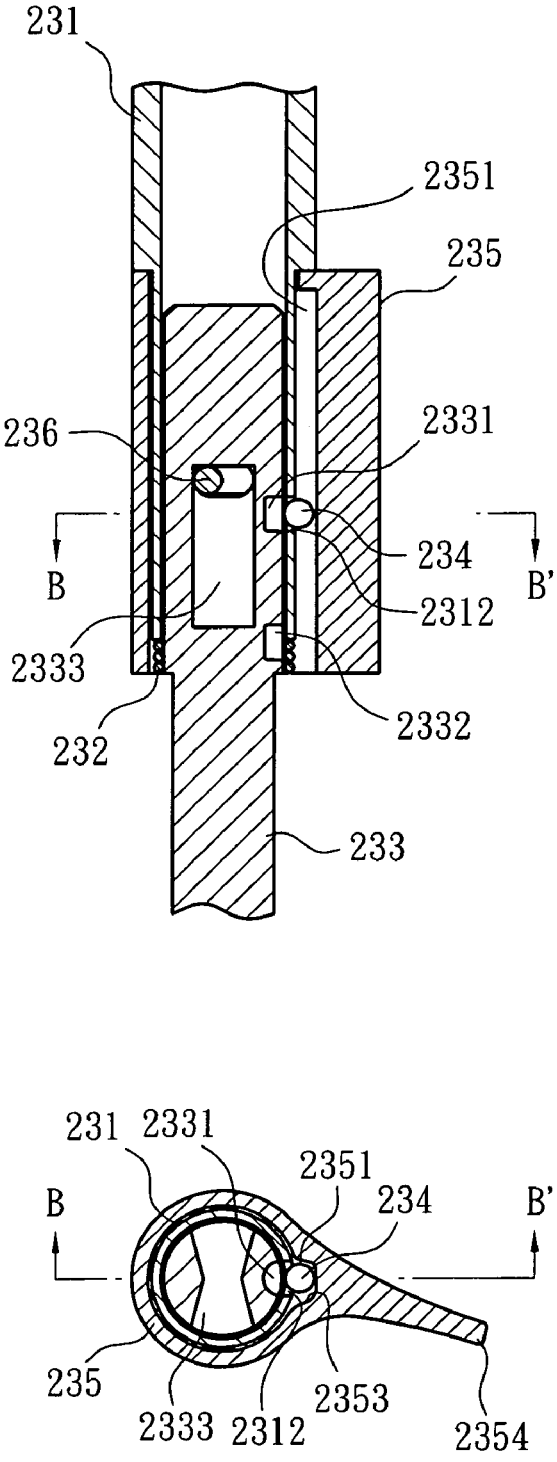

When a user desires to adjust the inclination of the inclination-adjustable seat 2, he/she can operate the gripping portions 2354 of the two adjusting members 235 to rotate with respect to the center of the seat frame 22 (in the meanwhile, the elastic element 232 produces resilience in response to rotating tension, as shown in FIGS. 2A-2B). At this time, the channel 2351 of the adjusting member 235 coincides with the receiving hole 2312, so that the positioning element 234 falls into a space formed by the channel 2351 and the receiving hole 2312 (as shown in FIG. 4A) due to the effect of gravity and the rolling movement (of steel bead). Further, the connecting tube 231 is able to move with respect to the supporting rod 233 to align the positioning hole 2331 with the receiving hole 2312 (as shown in FIG. 3B). When the operating force applied to the adjusting members 235 is released, the adjusting members 235 return to the original positions due to the resilience of the elastic element 232 (as shown in FIG. 3A), and the positioning element 234 slides back in the receiving hole 2312 and into the positioning hole 2331 along the slant surface 2353, thereby achieving the adjustment of inclination (that is, the inclination-adjustable seat 2 is now in the state of second inclination), as shown in FIG. 1B.

In the embodiment of the present invention, the inclination angle α in the state of second inclination is about 45 degrees to 50 degrees, or specifically, 49 degree in one embodiment. It is noted that the inclination angles α in the states of first and second inclinations are, but not limited to, 39 degrees and 49 degrees respectively. Different inclinations can be achieve by matching the positions of positioning holes having different designs. In another preferred embodiment of the present invention, adjustable inclinations of the first inclination and the second inclination can be in the range of 35 degrees to 55 degrees.

Given the disclosure of the present invention, one skilled in the art would appreciate that there may be other embodiments and modifications within the scope of spirit of the present invention. Accordingly, all modifications attained by one skilled in the art from the present disclosure within the scope and spirits of the present invention are to be included as further embodiments of the present invention. The scope of the present invention accordingly is to be defined as set forth in the appended claims.

What is claimed is:

1. An adjustment mechanism for adjusting the inclination of a seat, comprising:

a connecting tube configured to be connected to the seat at one end thereof and having a receiving hole;

a supporting rod configured to telescope with the connecting tube at one end thereof and to be connected to the seat at the other end thereof, the supporting rod having a plurality of positioning holes each of which can correspond respectively to the receiving hole;

a positioning element configured to be provided in the receiving hole and in one of the positioning holes corresponding to the receiving hole so that the supporting rod can be positioned to the connecting tube;

an adjusting member configured to adjust a position of the supporting rod with respect to the connecting tube, the adjusting member having a channel, wherein when the channel coincides with the receiving hole, the position of the supporting rod with respect to the connecting tube can be changed; and wherein the adjustment mechanism is rotatably connected to the connecting tube and further includes an elastic element, one end of the elastic element being connected to one end of the connecting tube, the other end of the elastic element being connected to the adjusting member.

2. An adjustment mechanism according to claim 1, wherein the channel has a slant surface enabling the positioning element to shift along the slant surface with the rotation of the adjusting member.

3. An adjustment mechanism according to claim 1, wherein the positioning element is a sphere body such that the position of the supporting rod with respect to the connecting tube can be changed by providing the sphere body in different positioning holes.

4. An adjustment mechanism according to claim 1, wherein the adjusting mechanism further includes a fastening element such that the fastening element penetrates first through holes of the connecting tube, second through holes of the adjusting member and a through opening of the supporting rod, thereby connecting the connecting tube, the adjusting member and the supporting rod, and wherein the first through holes are provided opposite to each other in the wall of the connecting tube, the adjusting member is in the form of hollow tube body, and the second through holes are provided opposite to each other in the wall of the tube body of the adjusting member.

5. An adjustment mechanism according to claim 1, wherein the adjusting member is a hand grip having a gripping portion, and the adjusting member can rotate with respect to the connecting tube.

6. An adjustment mechanism according to claim 1, wherein the size of the first through holes is substantially larger than that of the second through holes.

7. An inclination-adjustable seat comprising:

a connecting base;

a seat frame configure to be pivotally connected to the connecting base;

a supporting base configured to be pivotally connected to the connecting base, the supporting base being adapted to support the connecting base; and at least one adjustment mechanism configure to adjust the inclination of the inclination-adjustable seat, the adjustment mechanism being pivotally connected to the seat frame and the connecting base, the adjustment mechanism further including:

a connecting tube configured to be connected to the seat at one end thereof and having a receiving hole;

a supporting rod configured to telescope with the connecting tube at one end thereof and to be connected to the seat at the other end thereof, the supporting rod having a plurality of positioning holes each of which can correspond respectively to the receiving hole;

a positioning element configured to be provided in the receiving hole and in one of the positioning holes corresponding to the receiving hole so that the supporting rod can be positioned in the connecting tube; and an adjusting member configured to rotatably receive and telescope with the connecting tube and the supporting rod, the adjusting member having a channel, wherein when the channel coincides with the receiving hole, the positioning element moves out of the positioning hole corresponding to the receiving hole, thereby adjusting the inclination of the inclination-adjustable seat.

8. An inclination-adjustable seat according to claim 7, wherein the adjustment mechanism further includes an elastic element, one end of the elastic element being connected to one end of the connecting tube, the other end of the elastic element being connected to the adjusting member.

9. An inclination-adjustable seat according to claim 7, wherein the channel has a slant surface enabling the positioning element to shift along the slant surface with the rotation of the adjusting member.

10. An inclination-adjustable seat according to claim 7, wherein the positioning element is a sphere body such that the position of the supporting rod in the connecting tube changes by providing the sphere body in different positioning holes.

11. An inclination-adjustable seat according to claim 7, wherein the adjusting mechanism further includes a fastening element such that the fastening element penetrates first through holes of the connecting tube, second through holes of the adjusting member and a through opening of the supporting rod, thereby connecting the connecting tube, the adjusting member and the supporting rod, and wherein the first through holes are provided opposite to each other in the wall of the connecting tube, the adjusting member is in the form of hollow tube body, and the second through holes are provided opposite to each other in the wall of the tube body of the adjusting member.

12. An inclination-adjustable seat according to claim 7, wherein the adjusting member is a hand grip having a gripping portion, and the adjusting member can rotate with respect to the connecting tube.

13. An inclination-adjustable seat according to claim 7, wherein the size of the first through holes is substantially larger than that of the second through holes.

14. An inclination-adjustable seat according to claim 7, wherein the adjustable inclination is substantially in the range of 35 degrees to 55 degrees.

* * * * *